US011678784B2

(12) United States Patent
Omotola

(10) Patent No.: US 11,678,784 B2
(45) Date of Patent: Jun. 20, 2023

(54) SCRAPER SPONGE

(71) Applicant: Alahandro O. Omotola, Leesburg, VA (US)

(72) Inventor: Alahandro O. Omotola, Leesburg, VA (US)

(73) Assignee: Phiisagen Corporation, Leesburg, VA (US)

( * ) Notice: Subject to any disclaimer, the term of this patent is extended or adjusted under 35 U.S.C. 154(b) by 525 days.

(21) Appl. No.: 16/873,755

(22) Filed: Jun. 26, 2020

(65) Prior Publication Data

US 2020/0329942 A1 Oct. 22, 2020

Related U.S. Application Data

(60) Provisional application No. 63/102,051, filed on May 29, 2020.

(51) Int. Cl.

| | |
|---|---|
| ***A47L 13/12*** | (2006.01) |
| ***A47L 13/16*** | (2006.01) |
| ***A47L 13/08*** | (2006.01) |

(52) U.S. Cl.

CPC ..... *A47L 13/12* (2013.01); *A47L 13/08* (2013.01); *A47L 13/16* (2013.01)

(58) Field of Classification Search

CPC ..... A47L 13/12; A47L 13/16; A47L 13/20; A47L 13/254; A47L 13/08; A47L 13/02; A47L 17/04; A47L 17/06; A47L 17/08

(Continued)

(56) References Cited

U.S. PATENT DOCUMENTS

| | | | |
|---|---|---|---|
| 1,822,725 | A | 9/1931 | Cooper |
| 2,186,050 | A | 1/1940 | Vaughn |

(Continued)

*Primary Examiner* — Laura C Guidotti

(57) ABSTRACT

A scraper sponge for cleaning and scraping away unwanted substances from an object or surface comprising a sponge body defining a first surface, first layer, second layer, third layer, second surface opposite the first surface, a continuous side surface around the perimeter; and the back of a scraper attachment that is inserted through an aperture in layers two and three then rests firmly against the first layer where it borders the second layer and a smaller cylinder shaped part on the back of the scraper attachment is inserted through a smaller aperture approximately through the middle of the first layer and first surface and held in place by a scraper cap and fixedly secured with adhesive. The entire surface area of the scraper, on its front surface, is covered with pyramid shaped points extending outwardly in the direction of the second surface of the sponge body and is made level with the second surface of the sponge body when forces are applied to the top surface of the scraper cap and subsequent back of scraper attachment to manipulate the rigid scraper on a hard surface. The sponge body has three surfaces available for cleaning and scouring: the first surface, front scraper attachment surface and second surface. The seamless second layer, third layer, and continuous side surface of the second and third layer are made of the same sponge-like cellulose material. As an alternative, the second layer, third layer, second surface, and the continuous side surface of the second and third layer are not made of the same material and the sponge body has at least four surfaces adapted for cleaning and scouring; the first surface, scraper attachment front surface, the continuous side surface of layer two and the second surface.

36 Claims, 12 Drawing Sheets

(58) Field of Classification Search
USPC ..... 15/105, 118, 116.2, 119.2, 169
See application file for complete search history.

(56) References Cited

U.S. PATENT DOCUMENTS

| | | | | |
|---|---|---|---|---|
| 4,724,568 | A | 2/1988 | Englehardt | |
| 5,640,737 | A * | 6/1997 | Boggs | A47K 7/02 15/244.4 |
| 6,289,547 | B1 * | 9/2001 | Narula | A46B 9/06 15/104.94 |
| 7,284,293 | B1 * | 10/2007 | Holder | B08B 1/00 15/210.1 |
| 7,779,501 | B2 * | 8/2010 | Lacotta | A47L 13/256 15/228 |
| 10,426,312 | B1 | 10/2019 | Kersey | |
| 10,441,131 | B2 | 10/2019 | Frontera | |
| 10,932,643 | B2 * | 3/2021 | Omotola | A47L 13/12 |
| 11,185,208 | B1 * | 11/2021 | Dunn | A47L 13/51 |
| 2001/0044980 | A1 | 11/2001 | Duplessis | |
| 2003/0133739 | A1 * | 7/2003 | Zhadanov | A47L 13/12 15/205 |
| 2008/0216260 | A1 | 9/2008 | Silverman | |
| 2009/0276971 | A1 * | 11/2009 | Nozari | B32B 5/026 15/244.4 |
| 2010/0088839 | A1 | 4/2010 | Georgieff | |
| 2013/0233345 | A1 | 9/2013 | Baarsch | |
| 2014/0165317 | A1 | 6/2014 | Diener | |
| 2019/0313874 | A1 * | 10/2019 | Omotola | A47L 13/02 |
| 2019/0365188 | A1 | 12/2019 | Omotola | |

* cited by examiner

SCRAPER SPONGE

BACKGROUND OF THE INVENTION

The present invention relates to sponges and, more particularly, to scraper sponges made of natural and/or man-made materials adapted for cleaning and scraping a desired area.

Sponges have been used for many years as a tool for cleaning cookware, utensils, kitchen and bathroom surfaces, automobile surfaces, windows, floors, furniture and a myriad of other objects and surfaces. Sponges are used in these applications in part because they are absorbent, reusable, lightweight, and easy to grasp and manipulate. However, a primary disadvantage of sponges is that by themselves, sponges are too soft and pliable to scrape away unwanted substances such as dirt, hardened oils or grease, mildew, and waxes or foods that stick and adhere to surfaces and reside in corners, grooves and crevices. To remedy this problem, abrasive layers have been added to sponges to enable users to scrape away substances. However, abrasive layers do not effectively allow users to efficiently remove hardened substances or substances residing in tight corners, grooves and crevices because neither the sponge nor the abrasive layer provide a rigid enough edge, particularly when saturated with liquid, to enable users to impart the requisite forces necessary for scraping and removing unwanted substances from these tight locations and, in some cases, from flat surfaces as well.

For the foregoing reasons, there is a need for a scraper sponge that enables users to effectively scrape away and remove unwanted substances adhering to flat surfaces and/or found in difficult to reach locations, is easy to grasp and manipulate, is lightweight, and is economical to manufacture for consumer use.

BRIEF SUMMARY OF THE INVENTION

Sponges have been used for many years as a tool for cleaning cookware, utensils, kitchen and bathroom surfaces, automobile surfaces, windows, floors, furniture and a myriad of other objects and surfaces. Synthetic sponges, first developed by DuPont in 1940, have since largely replaced authentic sea sponges for household and industrial use.

Sponges are used because they are absorbent, reusable, and lightweight. However, a primary disadvantage of sponges is that by themselves, sponges are too soft and pliable to scrape away unwanted substances such as dirt, hardened oils or grease, mildew, and waxes or foods that stick and adhere to surfaces and reside in corners, grooves and crevices. Abrasive layers do not effectively allow users to remove substances residing in tight corners, grooves and crevices because neither the sponge nor the abrasive layer provide a rigid enough edge, to enable users to impart the requisite forces necessary for scraping and removing unwanted substances from the tight locations and from flat surfaces.

Several types of sponge/scraper implements have been proposed. For example, in U.S. Patent Application No. 2008/0216260 to Silverman et al., an integrated scraper and sponge device is disclosed. While this invention is an improvement upon the use of a sponge alone for removal of difficult and persistent deposits or films, it has several disadvantages. The attachment of the scraper portion to the sponge portion precludes use of the total sponge surface area, making the use of this device inconvenient and allowing the use of only one full surface of the sponge. In a second embodiment of the above invention, the scraper of the sponge is not securely inserted into the aperture in the sponge and this does not allow for easy grasp and use of the scraper without the sponge; the scraper is not wide. Also, use of the sponge in this manner can injure the hand as there is no support for the scraper in the soft sponge. Albeit, within the wet frictionless aperture of the sponge. Moreover, the pliable nature of the sponge make grasping the scraper portion all the more difficult for simple and effective removal of unwanted materials. In addition, the scraper is small and narrow which is not economical and requires excess scraping to cover a greater surface area. The inventor also does not describe how the blade is movably attached for the disclosed scraper design.

U.S. Pat. No. 7,984,527 to Georgieff discloses a scraper attachment for sponges that employs a large handle, attachable to the top surface of a sponge, for facile control of the sponge and ergonomic application of hand pressure for effective scraper action. While this device in an improvement over a sponge alone, its design is bulky, and makes access to tight areas difficult if not impossible. The scraper portion of the device does not include a serrated edge, and moreover the application of the device precludes complete use of the sponge surface area. As with the previous disclosure, this device only works with one type of sponge. Other examples include U.S. Pat. No. 4,724,568 to Englehardt, describing a scraper formed integrally with a sponge pad.

U.S. Pat. No. 9,138,121 to Baarsch et al. discloses a scraper attachment for select sponges. It requires the process of impaling a pointed rod through the sponge to work; this can be unsafe. It is bulky, not economical, and only one side of the sponge can be used with this device.

U.S. Pat. Publication No. 20190365188-A1 to Omotola et al. discloses a similar scraper sponge with a scraper inserted through a hole in the middle of the sponge and fixedly secured to the sponge with adhesive. Hence, the scraper cannot be held firmly against the first layer without adhesive. In addition, the angular forces applied to the back of the sponge and scraper to manipulate the scraper cause the bond between the scraper and the sponge to weaken or break prematurely rendering the scraper useless without the sponge. This is also a manufacturing defect that adds excess time and cost to the manufacturing process to correct.

The consumer is faced with few choices of such devices that are currently available on the market, and further rebuffed by the limitations of such devices that have been disclosed above. Proctor and Gamble Company currently have at least two integrated sponge/scraper combination products on the market, distributed by Butler Home Products LLC. These products are largely not reusable, difficult to hold, and one of these products completely covers the top surface of the sponge, reducing the usable area of the sponge.

A device offering total flexibility to be used for all cleaning applications is currently not available on the market. Furthermore, the consumer cannot find a scraper sponge that is lightweight, easily grasped and manipulated, comfortable in the hand, allows majority use of eight sides of the sponge and that is economical to manufacture for consumer use. Hence, there is a need for a scraper sponge of this magnitude.

DETAILED DESCRIPTION OF THE INVENTION

Figure 1:
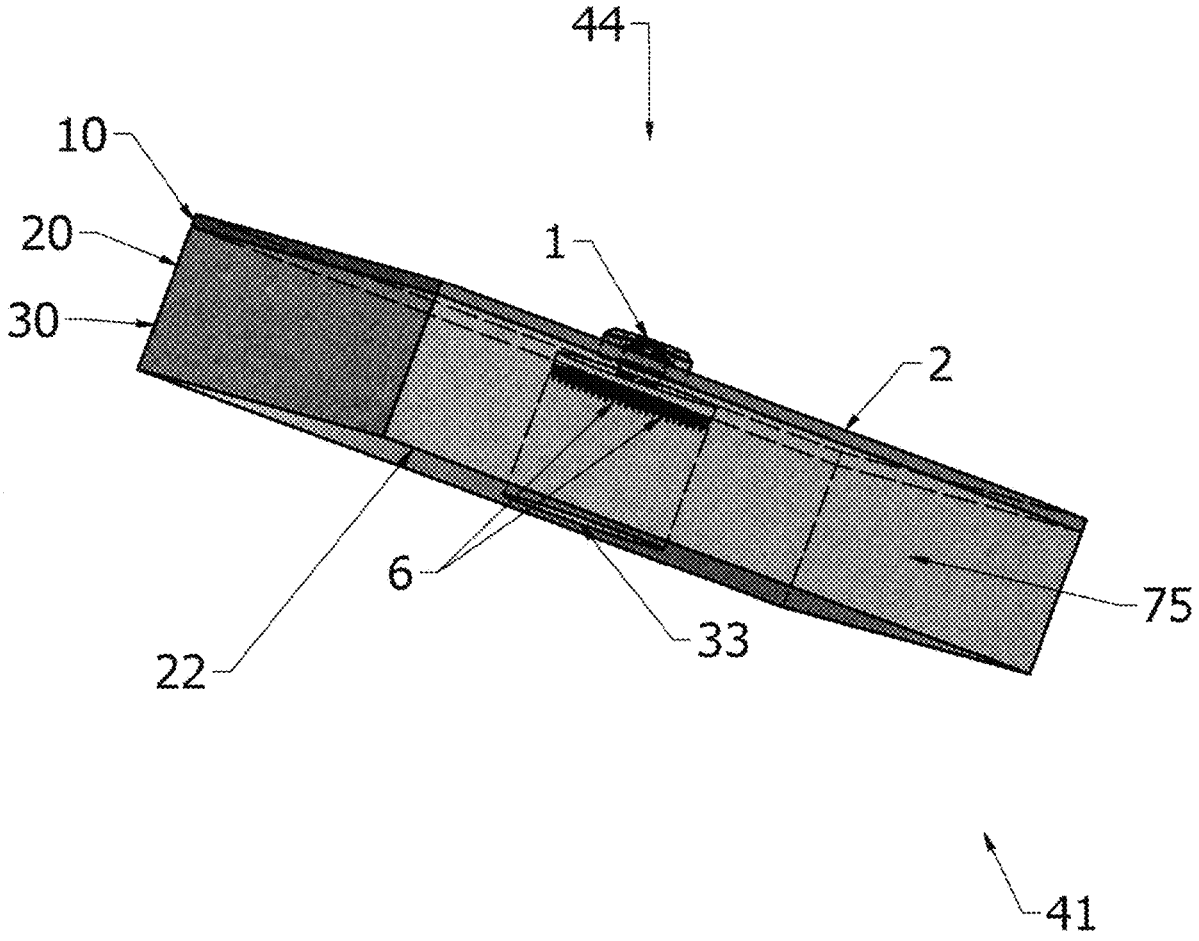
FIG. 1 is an angled bottom and length-sided semi-opaque view of the scraper sponge and all of its components according to an embodiment of the invention.

The present invention is directed to a scraper sponge and/or pad adapted for scraping and removing unwanted substances such as dirt, hardened oils or grease, mildew, waxes, stuck on foods, or other substances that adhere to surfaces and reside in corners, grooves and crevices.

Referring to FIGS. (1 Thru 4) an embodiment of the scraper sponge is shown and generally indicated by reference numeral 41. The scraper sponge 44 comprises a sponge body 41 defining a first surface 2, second surface 22 opposite first surface, and a continuous side surface 75 around the perimeter of the scraper sponge. The sponge body 41 can be made from numerous materials such as polyester foam, natural sponges, polyurethane foams, cellulose fiber, absorbent arrays of synthetic fibers or any type of material or combination thereof. The invention is not limited in this regard, and any appropriate sponge material that is currently known or later becomes known to those skilled in the art may be used. In one embodiment, the sponge body 41 is rectangular. However, the invention is not limited in this regard as the sponge body 41 could be any shape appropriate for cleaning such as polygon, oval, square, circle, triangle, trapezoid, etc.

Figure 13:
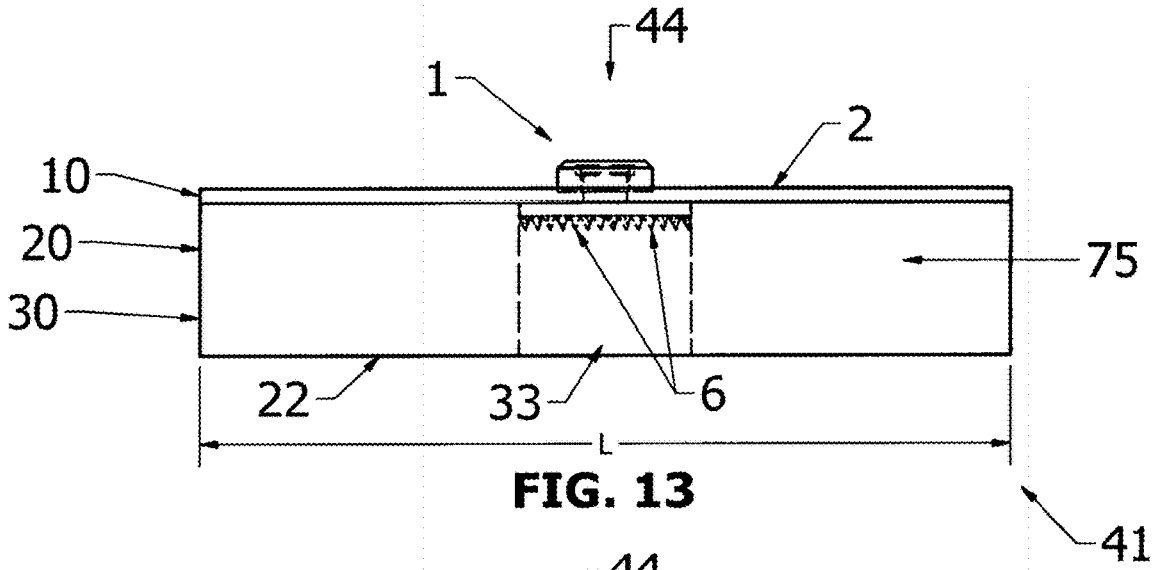
FIG. 13 is a transparent length side view of the scraper sponge and all of its components according to an embodiment of the invention.
Figure 14:
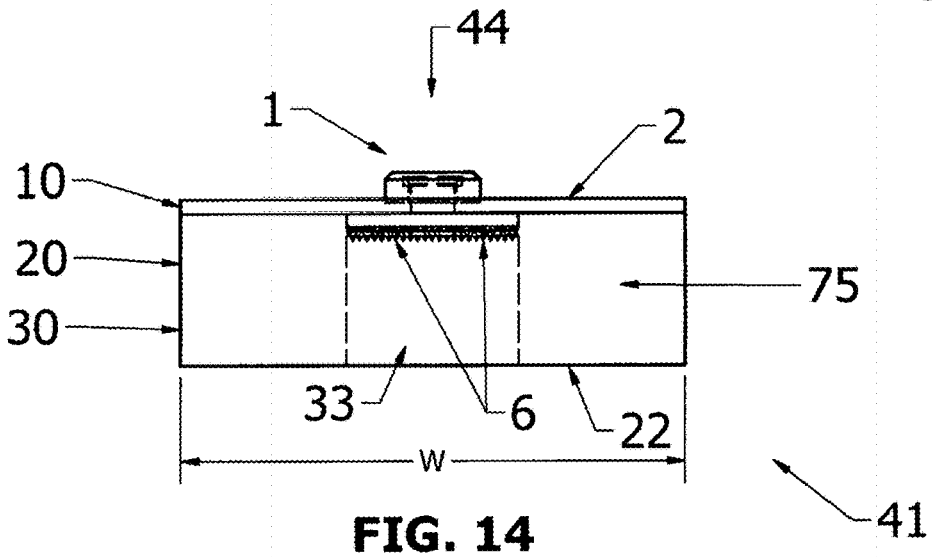
FIG. 14 is a transparent width-side view of the scraper sponge and all of its components according to an embodiment of the invention.
Figure 15:
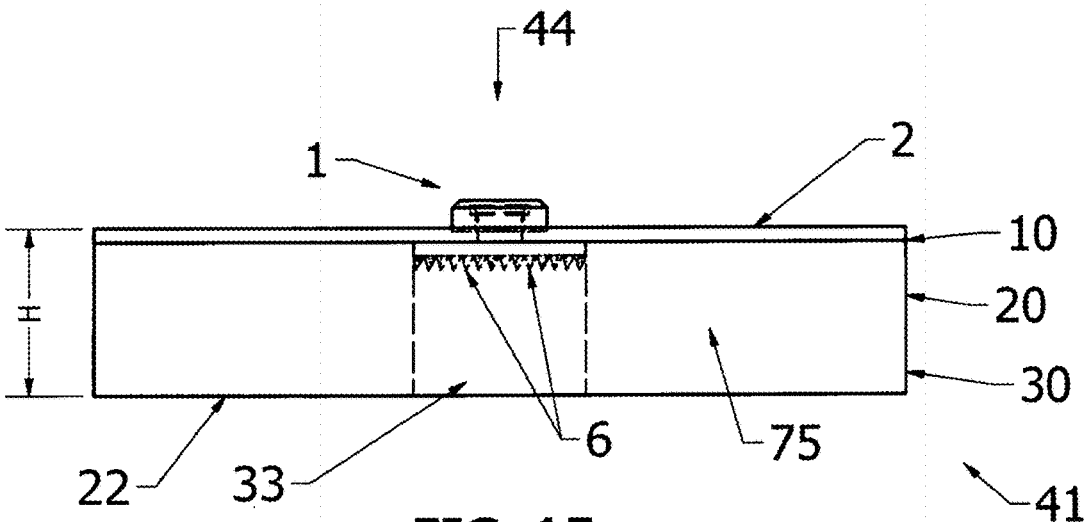
FIG. 15 is a transparent length side view of the scraper sponge and all of its components according to an embodiment of the invention.

Furthermore, the sponge body 41 is not limited by size in any dimension. In one embodiment, the length L (FIG. 13) of the sponge body 41 ranges from about 3 inches to about 23 inches, while the width W (FIG. 14) ranges from about 2 inches to about 15 inches; for circular sponges (not shown), the diameter ranges from about 3 inches to about 16 inches. In another embodiment, the length L of the sponge body 41 ranges from about 3 inches to about 14 inches, while the width W ranges from about 2 inches to about 7 inches; for circular sponges, the diameter ranges from about 3 inches to about 12 inches. In yet another embodiment, the length L of the sponge body 41 ranges from about 4 inches to about 12 inches, while the width W ranges from about 2 inches to about 4 inches; for circular sponges, the diameter ranges from about 4 inches to about 8 inches. With respect to the thickness H (FIG. 15) of the sponge body 41, in one embodiment, the thickness H ranges from about 1 inch to about 5 inches. In another embodiment, the thickness H of the sponge body 5 ranges from about 1 inch to about 7 inches. In yet another embodiment, the thickness H of the sponge body 5 ranges from about 1 inch to about 3 inches.

Figure 2:
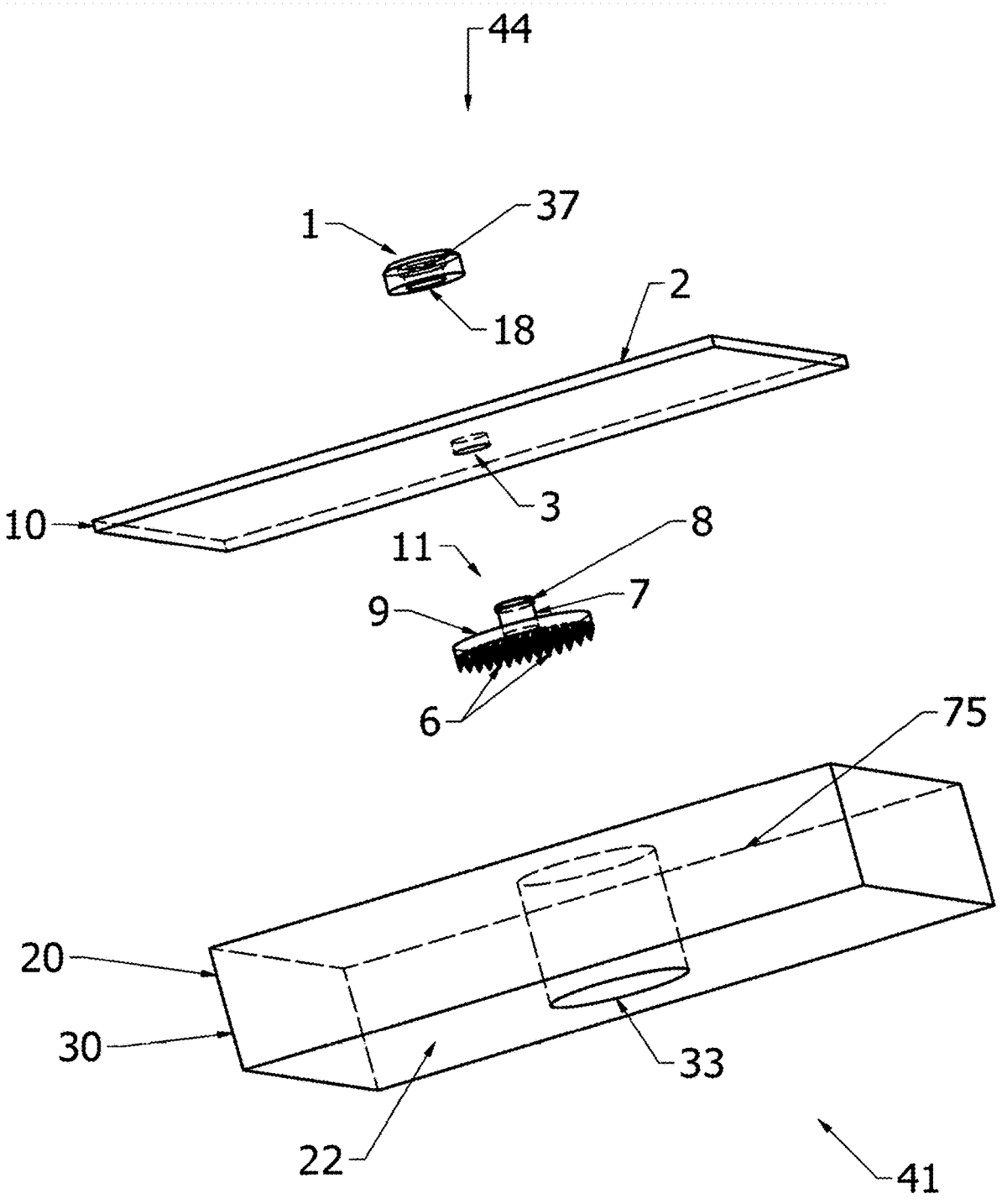
FIG. 2 is a right length-sided exploded view of the scraper sponge and all of its components according to an embodiment of the invention.
Figure 16:
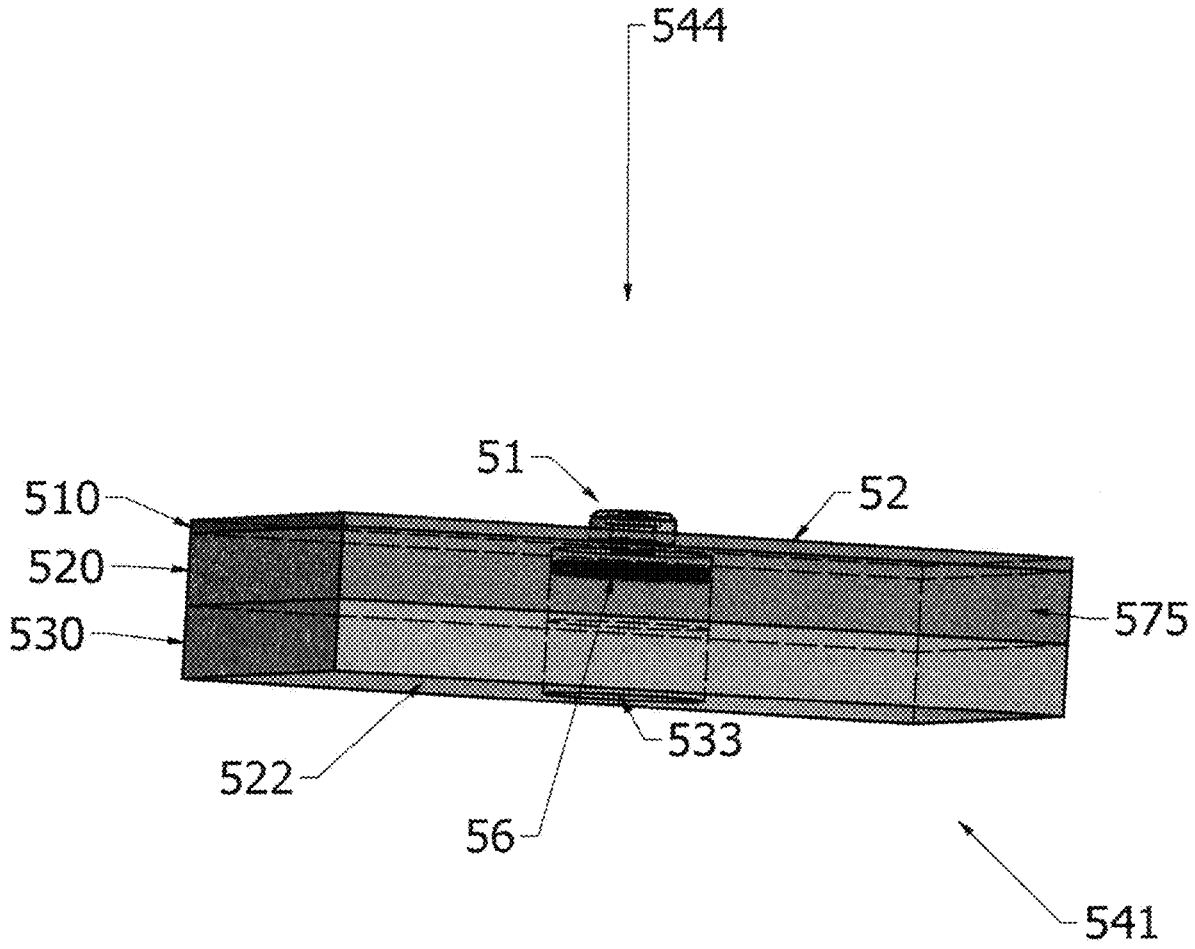
FIG. 16 is a transparent angled length-side view of the scraper sponge and all of its components according to a second embodiment of the invention.
Figure 17:
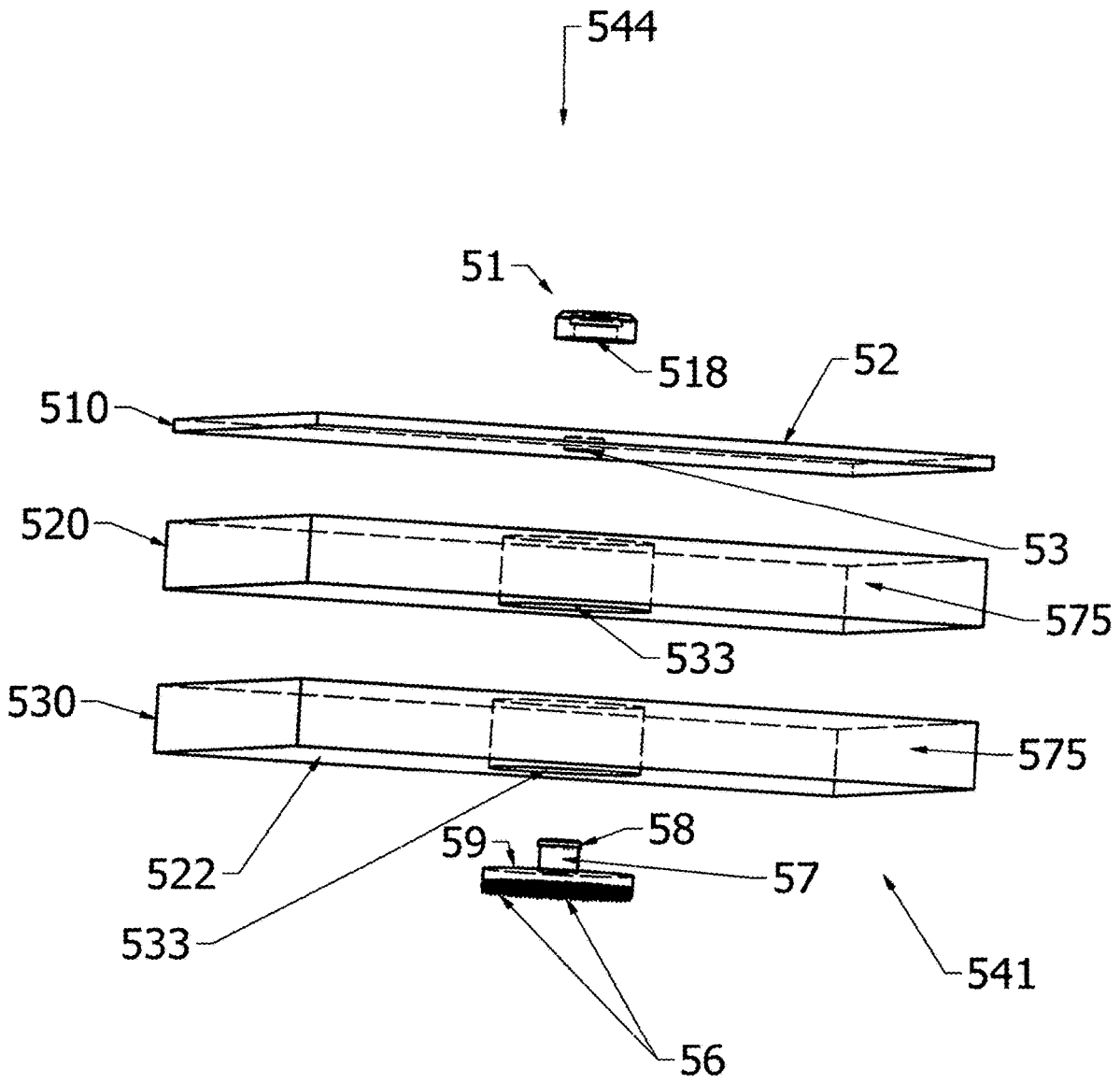
FIG. 17 is a hidden line angled and exploded length side view of the scraper sponge and all of its components according to a second embodiment of the invention.

Referring to FIGS. (1 thru 3) the scraper sponge 44 defines a sponge body 41 defining an outer continuous side surface 75 including a first surface 2, a second surface 22, and a scraper attachment 11 inserted into a circular aperture 33 approximately through the middle of the seamless, third layer 30 and second layer 20, and then a smaller cylinder shaped part 7 of the scraper attachment 11 inserted through a smaller circular shaped aperture 3 approximately through the middle of the first layer 10 and then inserted into hole 18 in scraper cap 1. An exploded view of the scraper sponge 44 is shown in FIG. 2. In one embodiment, the rear 9 of scraper attachment 11 rests against the bottom surface of first layer 10 where is borders second surface 20 and the smaller cylinder shaped part 7 of scraper attachment 11 of FIG. 1 is inserted into hole 18 of scraper cap 1 and the bottom of scraper cap 1 rests firmly against first surface 2 and scraper cap 1 is fixedly secured to scraper attachment 11 by way of the lip 8 on the smaller cylinder shaped part 7 of scraper attachment 11 and the female groove 37 in scraper cap 1 and scraper cap 1 is further secured to scraper attachment 11 by applying adhesive (not shown) between the two or by way of heat fusion or by any other method that is currently known or later becomes known to one skilled in the art. In another embodiment, (FIG. 16) the rear 9 of scraper attachment 11 rests firmly against first layer 10 where it borders second layer 20 and the female groove 37 in scraper cap 1 is fixedly secured to scraper attachment 11 by way of the lip 8 on the smaller cylinder shaped part 7 of scraper attachment 11 and scraper cap 1 is further secured to scraper attachment 11 by applying adhesive (not shown) between the two or by way of heat fusion or by any other method that is currently known or later becomes known to one skilled in the art. An exploded view of this is embodiment is presented in FIG. 17.

Figure 5:
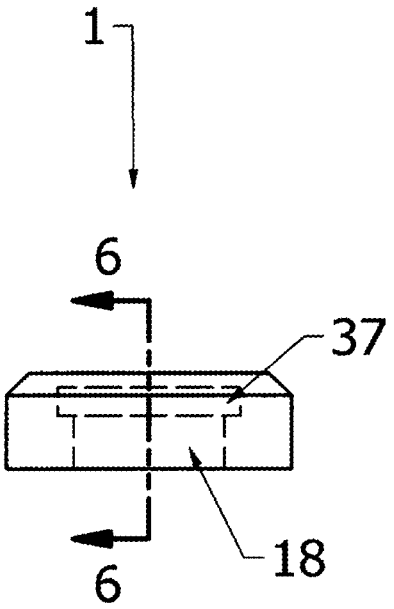
FIG. 5 is a transparent side view of the scraper cap according to an embodiment of the invention.
Figure 6:
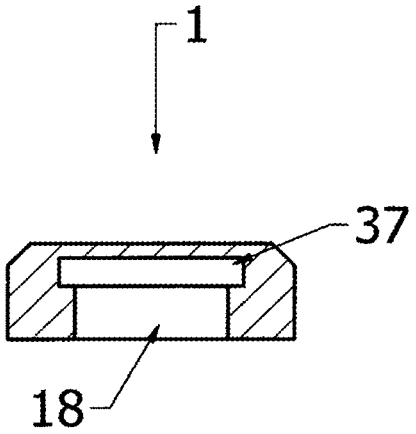
FIG. 6 is a transparent side section-view of the scraper cap of FIG. 5 according to an embodiment of the invention.
Figure 7A:
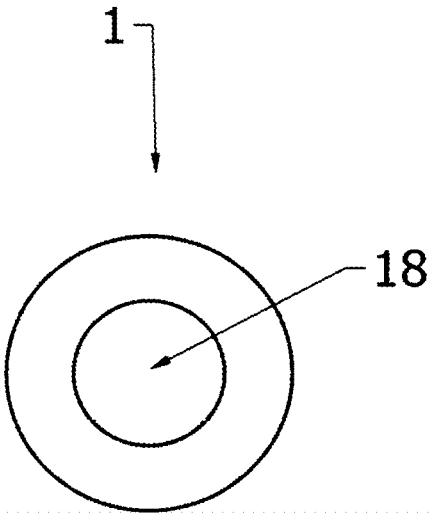
FIG. 7A is a bottom view of the scraper cap according to an embodiment of the invention.
Figure 7B:
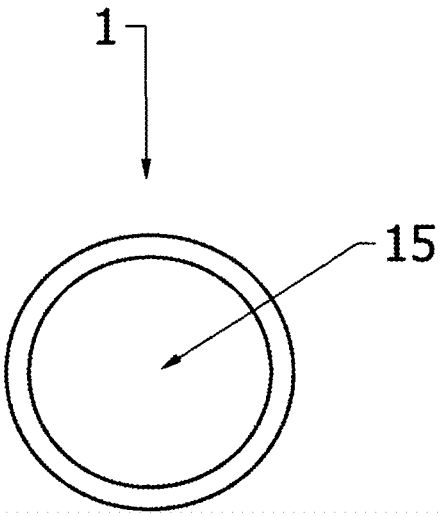
FIG. 7B is a top view of the scraper cap according to an embodiment of the invention.
Figure 8A:
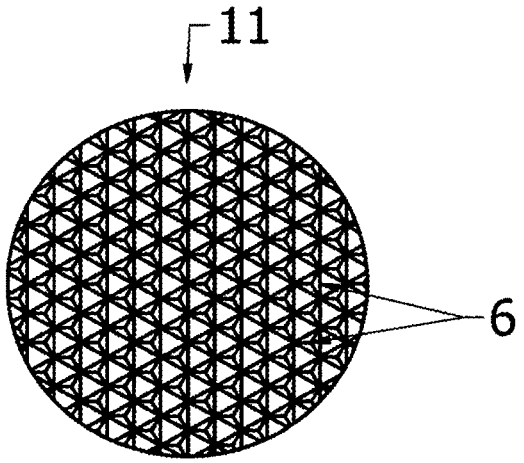
FIG. 8A is a front view of the scraper attachment according to an embodiment of the invention.
Figure 8B:
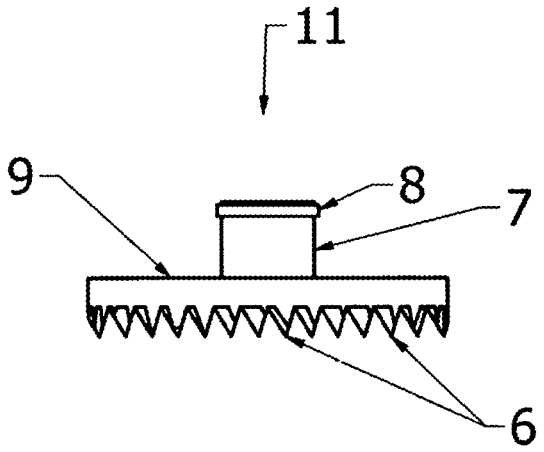
FIG. 8B is a side-view of the scraper attachment according to an embodiment of the invention.
Figure 8C:
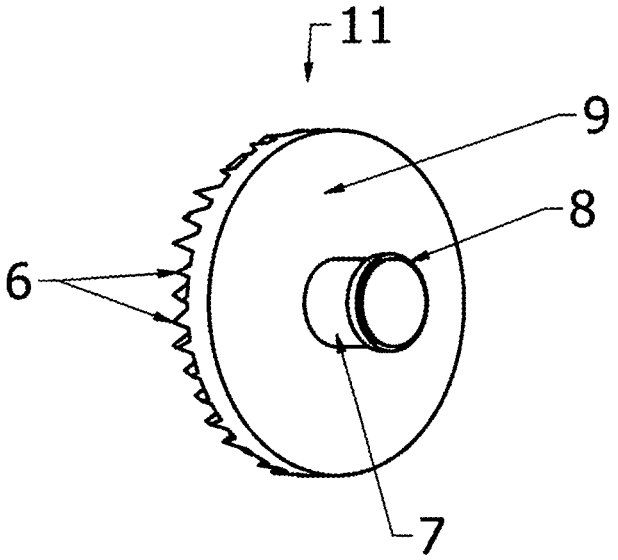
FIG. 8C is an angled rear side-view of the scraper attachment according to an embodiment of the invention.
Figure 9:
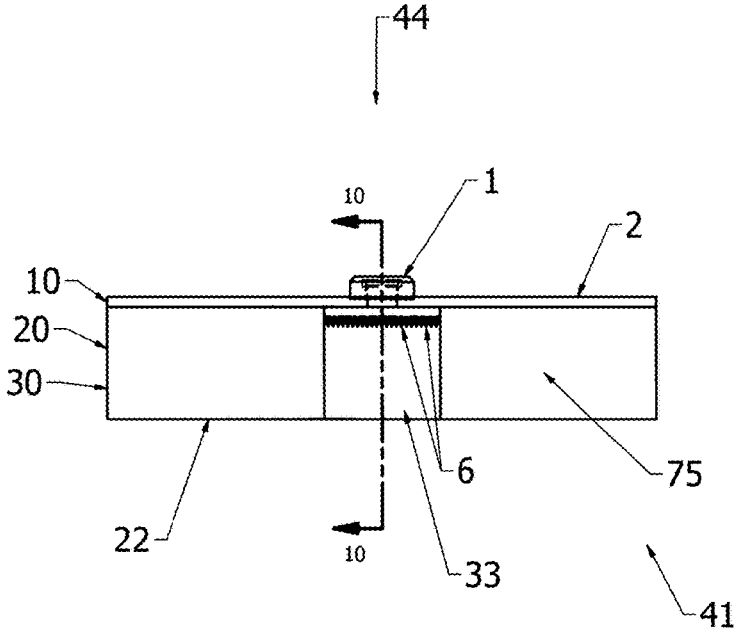
FIG. 9 is a transparent length side view of the scraper sponge and all of its components according to an embodiment of the invention.
Figure 10:
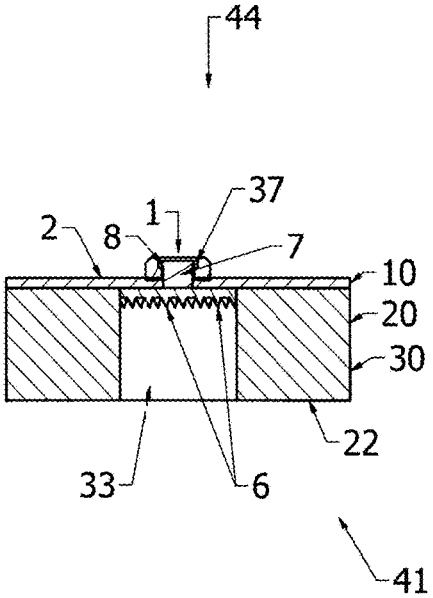
FIG. 10 is a transparent width-side sectional-view of the scraper sponge of FIG. 9 and all of its components according to an embodiment of the invention.
Figure 11:
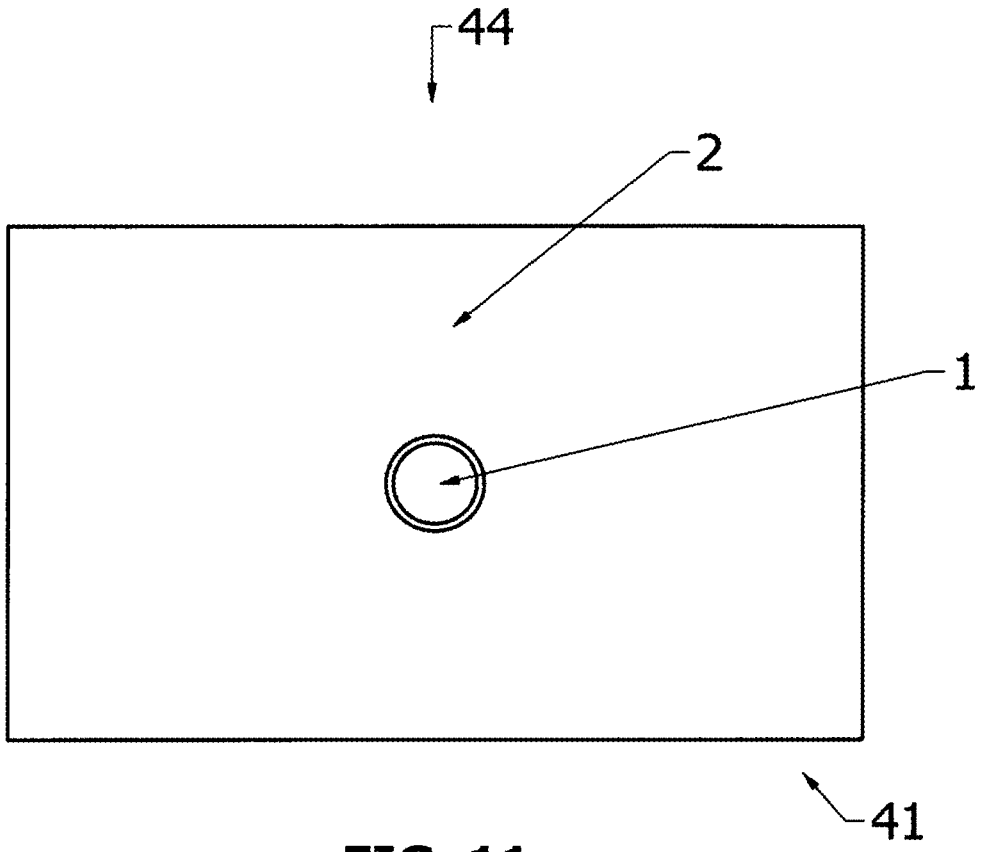
FIG. 11 is a top view of the scraper sponge and all of its components according to an embodiment of the invention.
Figure 12:
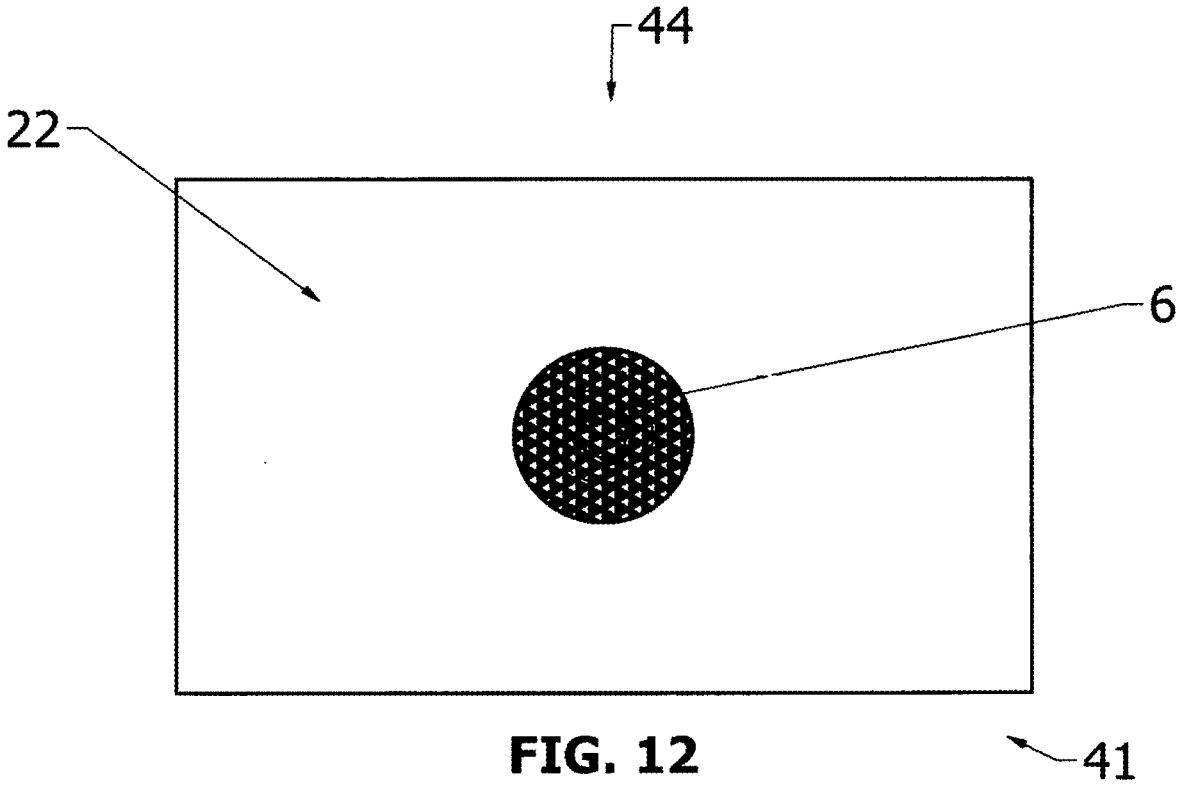
FIG. 12 is a bottom view of the scraper sponge and all of its components according to an embodiment of the invention.

The rear 9 of scraper attachment 11 (FIG. 8C) rests firmly against the first layer 10 of sponge body 41 and is firmly held in place using scraper cap 1 (FIG. 5) and an adhesive (not shown). The scraper cap 1 and scraper attachment 11 can be any size smaller than the surface area of the sponge body 41. The scraper attachment 11 on its front surface (FIG. 8A) has approximately 90 defined pyramid shaped edges 6, depending on the front surface area of scraper attachment 11 (FIG. 8A). The pyramid shaped edges 6 extend outwardly toward the second surface 22. The pyramid shaped edges 6 of scraper attachment 11 range from being semi rigid to substantially rigid for scraping unwanted substances and is narrow at its circular border for entering tight corners, groves and crevices and for effectively scraping surfaces. The scraper attachment 11 and scraper cap 1 can be any shape; circular, rectangular, polygonal, etc. . . . The top surface 15 of scraper cap 1 (FIG. 7B) when scraper cap 1 is fixedly secured to scraper attachment 11 by way of the female groove 37 in scraper cap 1 and the lip 8 of scraper attachment 11 defines a flat depressible surface to which normal and angular forces are applied by the user to manipulate the scraper attachment 11 and apply pressure as required to scrape away and remove substances where desired. The scraper cap 1 and scraper attachment 11 can be made from numerous materials such as natural rubber, synthetic rubber, plastics, polymers, wood, metal or any combination thereof. The invention is not limited in this regard, and any appropriate scraper attachment 11 and scraper cap 1 material that is currently known or later becomes known to those skilled in the art may be used. For improved manipulation and scraping, the top surface 15 of the scraper cap 1 is flat and circular in shape and, depending on the size of the scraper cap 1, is adapted for receiving depending on the size, is adapted for receiving at least a portion of: (i) a human finger, (ii) multiple human fingers, (iii) a human hand, or (iv) two human hands, for applying pressure and manipulating the scraper attachment 11.

Figure 3:
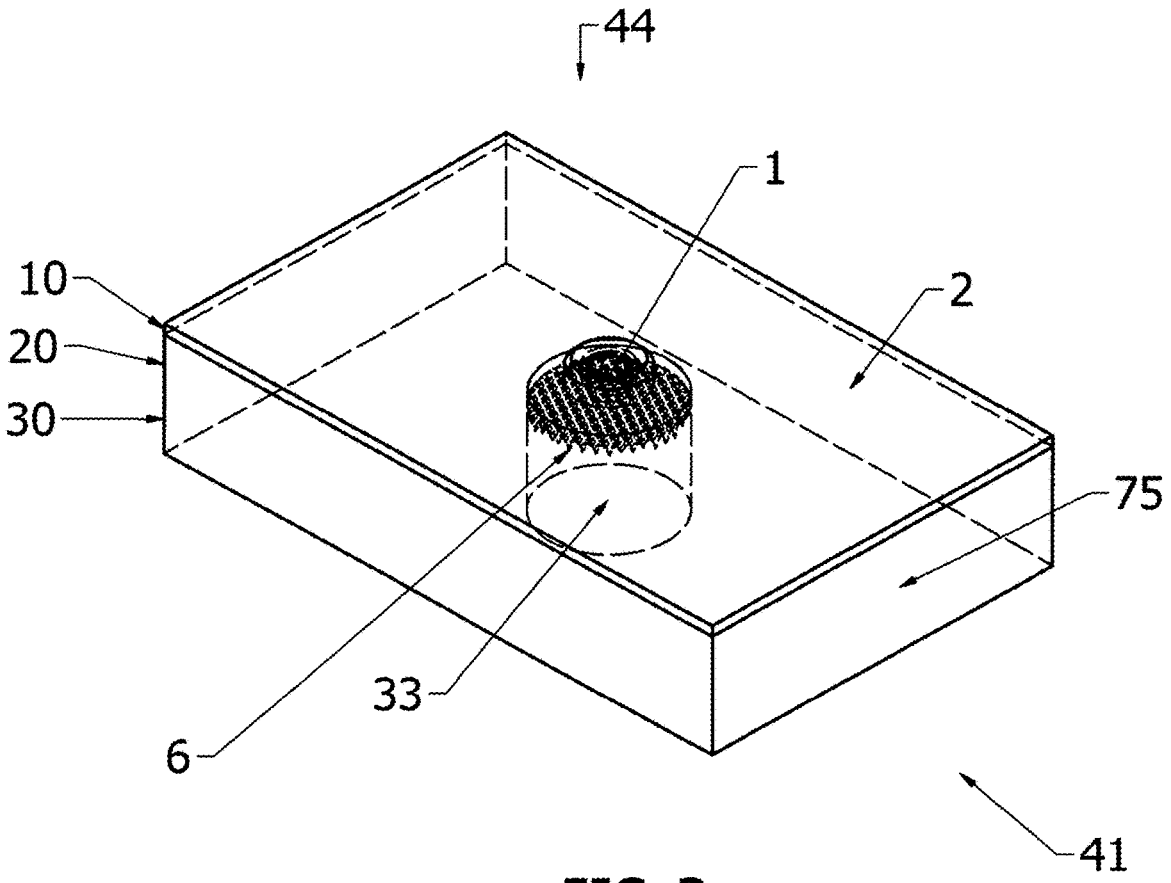
FIG. 3 is a top angled left length-sided hidden line view of the scraper sponge and all of its components according to an embodiment of the invention.
Figure 4:
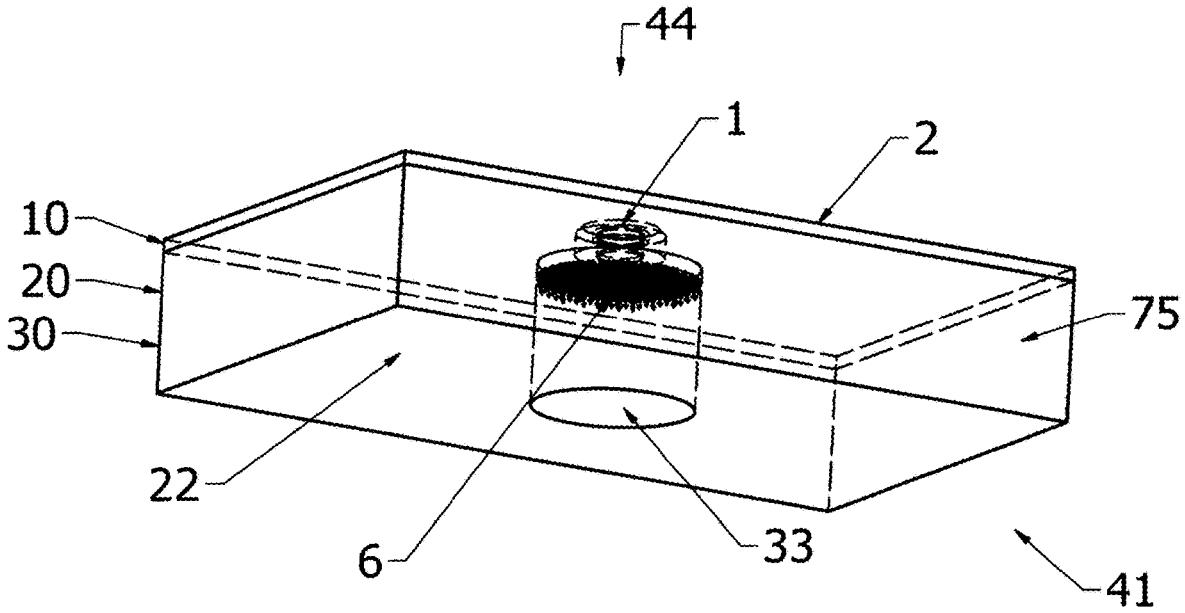
FIG. 4 is a bottom angled right length-sided hidden line view of the scraper sponge and all of its components according to an embodiment of the invention.
Figure 18:
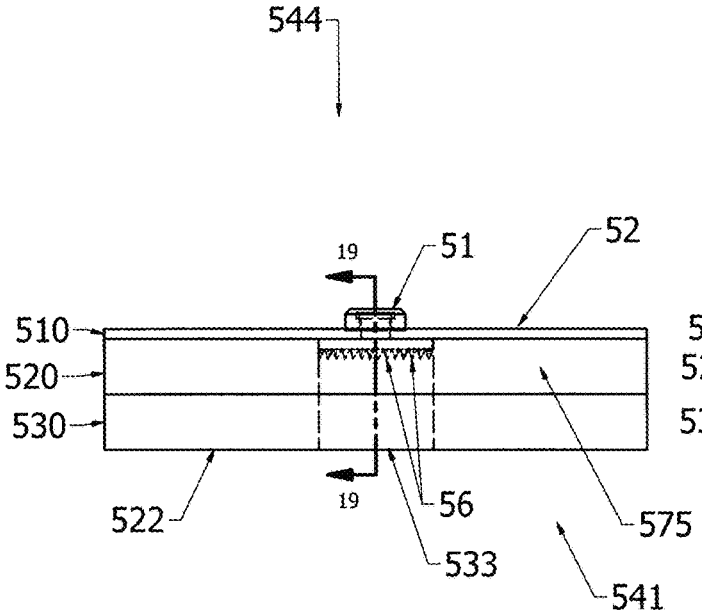
FIG. 18 is a transparent length-side view of the scraper sponge and all of its components according to a second embodiment of the invention.
Figure 19:
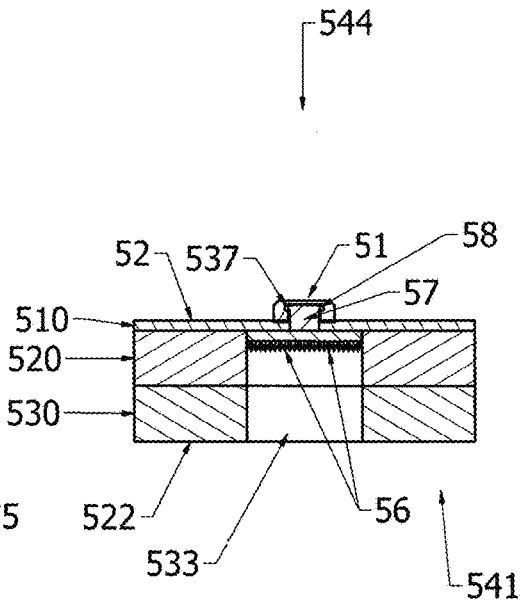
FIG. 19 is a transparent width-side section view of the scraper sponge of FIG. 18 and all of its components according to a second embodiment of the invention.
Figure 20:
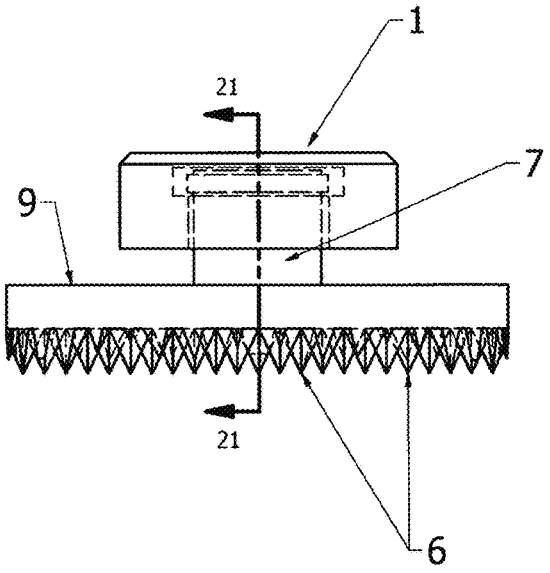
FIG. 20 is a transparent side view of the connected scraper cap and scraper attachment.
Figure 21:
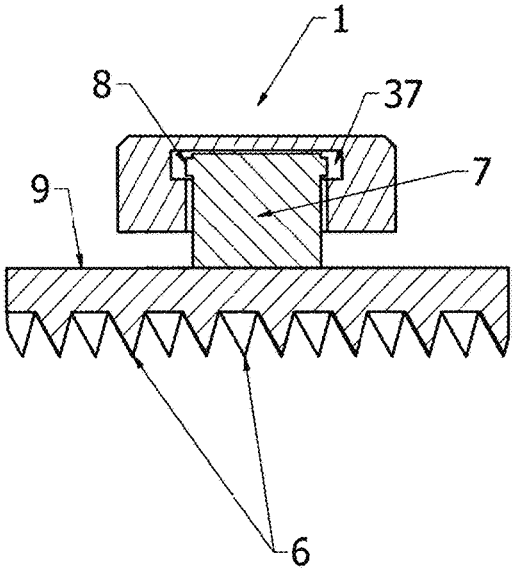
FIG. 21 is a transparent sectional view of the connected scraper cap and scraper attachment.

In one embodiment, shown in (FIG. 1), the sponge body 41 comprises multiple layers including a first layer 10 defining the first surface 2 and a second layer 20 defining a third layer 30 defining a second surface 22. The first layer 10 and second layer 20 and third layer 30 are heat fused and/or bonded together using an adhesive (not shown), or by any method that is currently known or later becomes known to those skilled in the art. In one embodiment, the second layer 20, third layer 30, and second surface 22, are made of the same material and are seamlessly heat fused and/or bonded together using an adhesive (not shown), or by any method that is currently known or later becomes known to those skilled in the art. The first surface 2 and first layer 10 can be made from numerous materials such as nylon, polypropylene, polyester foam, melamine, natural sponges, polyurethane foams, cellulose, absorbent arrays of synthetic fibers, and non-woven materials or any combination thereof. The second layer 20, third layer 30, and second surface 22, can be made from numerous materials such as nylon, polypropylene, polyester foam, melamine, natural sponges, polyurethane foams, cellulose, absorbent arrays of synthetic fibers, and non-woven materials or any combination thereof. The scraper sponge 44 layers can be made from any material that is known or later becomes known to those skilled in the art. In one embodiment, the first surface 2 and first layer 10 are made from nylon. The second layer 20, third layer 30, and second surface 22 are indistinguishable and made from cellulose fiber. In one embodiment, (FIGS. 3 and 4), the rear 9 of scraper attachment 11 (FIG. 8C) is inserted through the circular aperture 33 approximately through the middle of the second surface 22 third surface 30 and second surface 20 and the rear 9 of scraper attachment 11 rests securely against first layer 10 where it borders layer two 20 and its smaller cylinder shaped part 7 is inserted through the circular aperture 3 approximately in the middle of the first layer 10 and first surface 2 and then inserted into hole 18 of scraper cap 1 and scraper attachment 11 is fixedly secured to sponge body 41 with scraper cap 1 and an adhesive (not shown) or heat fusion. The thickness of the second layer 20 and third layer 30 may comprise approximately 85% to about 90% of the total thickness of the scraper sponge 44. Preferably, the first layer 10 comprises between about 10% to about 20%, of the total thickness of the scraper sponge 44. In an alternative embodiment, (FIGS. 16, 17, and 18) the first layer 510 and second layer 520 comprise about 40% of the total thickness of the sponge body 541 and the third layer 530 comprises about 60%. All three layers can be made of different types of surface scrubbing materials.

Referring now to (FIGS. 16, 17, and 18), an alternative embodiment is shown where like numerals represent like elements and are preceded with the number "5". In this embodiment, the scraper sponge 544 defines a sponge body 541 defining an outer surface including a first surface 52, a first layer 510, and a second layer 520, a third layer 530 including a second surface 522, a continuous side surface 575, and a small circular aperture 53 extending through the first surface 52 and first layer 510 and a larger circular aperture 533 extending through the second surface 522 and third layer 530 and second layer 520 for receiving the scraper attachment 511. The rear 59 of scraper attachment 511 (FIG. 8C) rests securely against first layer 510 where it borders layer 520 and fits securely into the circular aperture 533 approximately through the middle of layer two 520 and layer three 530 and second surface 522 and the smaller cylinder shaped part 57 of scraper attachment 511 is inserted through the smaller circular aperture 53 of layer one 510 and first surface 52 and scraper attachment 511 is fixedly secured to sponge body 541 with scraper cap 51 and an adhesive (not shown) or heat fusion and like the scraper described above, has approximately 90 three dimensional pyramid shaped cones defining edges 56 and a depressible flat surface on the top 515 of scraper cap 51 to which forces are applied to manipulate the scraper attachment 511. For improved manipulation and scraping, the depressible surface on the top 515 of scraper cap 51 is flat and circular in shape and, depending on the size, is adapted for receiving at least a portion of: (i) a human finger, (ii) multiple human fingers, (iii) a human hand, or (iv) two human hands, for applying pressure and manipulating the scraper attachment 511 as noted above. The scraper edges 56 extend outwardly towards the second surface 522 from within the aperture 533 in the sponge body 541. As noted above, the sponge body 541 can comprise a first surface 52, a first layer 510, a second layer 520, a third layer 530, and a second surface 522. In this embodiment the materials used for the sponge body 541 and scraper attachment 511 and scraper cap 51 are consistent with the materials used in connection with the sponge body 41 and scraper attachment 11 and scraper cap 1 described above. One advantage of this embodiment is that it allows each layer 510, 520, and 530 to be made of a different textured material to be used for scrubbing and cleaning and/or polishing a surface. For example, layer one 510 can be made of a coarse grain scouring material, the continuous side surface 575 of the second layer 520 can be made of a melamine resin material, and the third layer 530 can be made of cellulose fiber.

In light of the above description of the scraper sponge 44, 544 an example of its use will now be described. With the scraper sponge 44, 544 and/or the desired object or surface for cleaning (not shown) prepared with water, soap, cleaning liquids, cleaning powders, or the like, the user places the sponge body 41, 541 in contact with said object or surface. The user then presses on the middle of the top of the scraper cap 1, 51 imparting downward pressure on the scraper attachment 11, 511 and sponge body 41, 541. The scraper cap 11, 51 through which pressure is applied to the scraper attachment 11, 511 and, in particular, the middle of the scraper attachment 11, 511 is compressed thereby allowing the scraper attachment 11, 511 to extend through the circular aperture 33, 533 into a position for contacting and scraping unwanted substances in a desired location. While maintaining the applied pressure, the user simultaneously moves the sponge body 41, 541 scraper attachment 11, 511 and scraper cap 1, 51 in, for example, a forward, circular or reciprocating motion to effectively scrape away and remove the unwanted substances. When the user is finished, both the sponge body and scraper can be cleaned for future applications. It should be noted that the sponge body 41, 541 can be used for cleaning and scouring purposes without engaging the scraper attachment 11, 511. Further, the scraper sponge 44, 544 can be used in a dry state without the addition of water, soap, cleaning liquids, cleaning powders, or the like.

The claimed invention is:

1. A scraper sponge for cleaning and scraping away unwanted substances from an object or surface, comprising:

a sponge body having a first layer with a first surface, a seamless second layer, a third layer with a second surface opposite the first surface, and a continuous side surface around a perimeter of the sponge body; and a scraper attachment having a back surface and a front surface;

wherein the back surface of the scraper attachment includes a cylinder shaped part having a protruding lip at an apex thereof and having a diameter smaller than a diameter of the back surface of the scraper attachment inserted through the third layer, the second layer, and the first layer such that the back surface of the scraper attachment rests firmly against the first layer where it borders the second layer;

wherein the scraper attachment is fixedly secured to the first layer by way of a scraper cap connected to the protruding lip of the cylinder shaped part by adhesive means selected from the group consisting of an adhesive, heat fusion, and combinations thereof at the apex thereof;

wherein a first circular aperture extends through approximately the middle of the first layer and a second circular aperture extends through approximately the middle of the second layer, the third layer and the second surface of the sponge body, the second circular aperture having a diameter larger than a diameter of the first circular aperture;

wherein the front surface of the scraper attachment is covered with pyramid shaped edges extending outwardly in a direction of the second surface of the sponge body; and wherein the scraper attachment is made level with the second surface of the sponge body when forces are applied to the top of the scraper cap and the back surface of the scraper attachment to manipulate the scraper attachment on a hard surface.

2. The scraper sponge of claim 1, wherein said sponge body is made of material selected from the group consisting of polyester foam, natural sponges, polyurethane foams, polymer foams, absorbent arrays of synthetic fibers and any combination thereof.

3. The scraper sponge of claim 1, wherein said scraper attachment is made of material selected from the group consisting of natural rubber, synthetic rubber, polymers, wood, metal, and any combination thereof.

4. The scraper sponge of claim 1, wherein said scraper cap is made of material selected from the group consisting of natural rubber, synthetic rubber, polymers, wood, metal, and any combination thereof.

5. The scraper sponge of claim 3, wherein said scraper attachment has a surface area smaller than a surface area of the sponge body.

6. The scraper sponge of claim 4, wherein said scraper cap has a surface area smaller than the surface area of the scraper attachment.

7. The scraper sponge of claim 5, wherein said scraper attachment is thin and circular in shape the protruding lip follows a circular curvature of the cylinder shaped part.

8. The scraper sponge of claim 7, wherein a locking mechanism results when the thin protruding lip of the scraper attachment rests within a female groove of the scraper cap.

9. The scraper sponge of claim 6, wherein said scraper cap is cylinder shaped with a closed, smooth top surface and an open hole in a bottom surface that opens into a female groove having a wider diameter than the open hole.

10. The scraper sponge of claim 9, wherein the female groove is adapted to encase the protruding lip at the rear apex of the scraper attachment.

11. The scraper sponge of claim 1, wherein said front surface of scraper attachment has approximately 90 three-dimensional pyramid shaped edges that are at least one of (i) semi rigid and (ii) substantially rigid.

12. The scraper sponge of claim 10, wherein said bottom surface of said scraper cap when attached to the scraper attachment rests firmly against the first surface.

13. The scraper sponge of claim 1, wherein said first surface and first layer is made of a coarse textured scouring material that ranges from rigid to semi-rigid.

14. The scraper sponge of claim 1, wherein said second layer is made of cellulose fiber.

15. The scraper sponge of claim 1, wherein said third layer is made of cellulose fiber.

16. The scraper sponge of claim 13, wherein a thickness of said first layer is between approximately 10% and about 15% of a thickness of the scraper sponge.

17. The scraper sponge of claim 14, wherein a total thickness of said second layer is approximately 40% to about 45% of a total thickness of the scraper sponge.

18. The scraper sponge of claim 15, wherein a total thickness of said third layer is between about 40% to about 45% of a total thickness of the scraper sponge.

19. A scraper sponge for cleaning and scraping away unwanted substances from an object or surface, comprising:

a sponge body having a first layer with a first surface, first layer, a second layer, a third layer with a second surface opposite the first surface, and a continuous side surface around a perimeter of the sponge body; and a scraper attachment having a back surface and a front surface;

wherein the back surface of the scraper attachment includes a cylinder shaped part having a protruding lip at an apex thereof and having a diameter smaller than a diameter of the back surface of the scraper attachment inserted through the third layer and the second layers, and the first layer such that the back surface of the scraper attachment rests firmly against the first layer where it borders the second layer;

wherein the scraper attachment is fixedly secured to the first layer by way of a scraper cap connected to the protruding lip of the cylinder shaped part by adhesive means selected from the group consisting of an adhesive, heat fusion, and combinations thereof at the apex thereof;

wherein a first circular aperture extends through approximately the middle of the first layer and a second circular aperture extends through approximately the middle of the second layer, the third layer and the second surface of the sponge body, the second circular aperture having a diameter larger than a diameter of the first circular aperture;

wherein the front surface of the scraper attachment is covered with pyramid shaped edges extending outwardly in a direction of the second surface of the sponge body; and wherein the scraper attachment is made level with the second surface of the sponge body when forces are applied to the top of the scraper cap and the back surface of the scraper attachment to manipulate the scraper attachment on a hard surface.

20. The scraper sponge of claim 19, wherein said sponge body is made of material selected from the group consisting of polyester foam, natural sponges, polyurethane foams, polymer foams, absorbent arrays of synthetic fibers and any combination thereof.

21. The scraper sponge of claim 19, wherein said scraper attachment is made of material selected from the group consisting of natural rubber, synthetic rubber, polymers, wood, metal, and any combination thereof.

22. The scraper sponge of claim 19, wherein said scraper cap is made of material selected from the group consisting of natural rubber, synthetic rubber, polymers, wood, metal, and any combination thereof.

23. The scraper sponge of claim 21, wherein said scraper attachment has a surface area smaller than a surface area of the sponge body.

24. The scraper sponge of claim 22, wherein said scraper cap has a surface area smaller than the surface area of the scraper attachment.

25. The scraper sponge of claim 23, wherein said scraper attachment is thin and circular in shape the protruding lip follows a circular curvature of the cylinder shaped part.

26. The scraper sponge of claim 25, wherein a locking mechanism when the protruding lip of the scraper attachment rests within a female groove of the scraper cap.

27. The scraper sponge of claim 24, wherein said scraper cap is cylinder shaped with a closed, smooth top surface and an open hole in a bottom surface that opens into a female groove having a wider diameter than the open hole.

28. The scraper sponge of claim 27, wherein the female groove is adapted to encase the protruding lip at the rear apex of the scraper attachment.

29. The scraper sponge of claim 19, wherein said front surface of scraper attachment has approximately 90 three-dimensional pyramid shaped edges that are at least one of (i) semi rigid and (ii) substantially rigid.

30. The scraper sponge of claim 28, wherein said bottom surface of said scraper cap when attached to the scraper attachment rests firmly against the first surface.

31. The scraper sponge of claim 19, wherein said first surface and first layer is made of a coarse textured scouring material that ranges from rigid to semi-rigid.

32. The scraper sponge of claim 19, wherein said second layer is made of a coarse textured.

33. The scraper sponge of claim 19, wherein said third layer is made of cellulose fiber.

34. The scraper sponge of claim 31, wherein a thickness of said first layer is between approximately 10% and about 15% of a thickness of the scraper sponge.

35. The scraper sponge of claim 32, wherein a total thickness of said second layer is approximately 40% to about 45% of a total thickness of the scraper sponge.

36. The scraper sponge of claim 33, wherein a total thickness of said third layer is between about 40% to about 45% of a total thickness of the scraper sponge.

* * * * *